US009150028B2

(12) United States Patent
Kobayashi

(10) Patent No.: US 9,150,028 B2
(45) Date of Patent: Oct. 6, 2015

(54) LIQUID CARTRIDGE CAPABLE OF REDUCING FORCE REQUIRED TO OPEN AIR CHANNEL AND LIQUID CHANNEL

(71) Applicant: Brother Kogyo Kabushiki Kaisha, Nagoya-shi, Aichi-ken (JP)

(72) Inventor: Tetsuro Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/616,204

(22) Filed: Feb. 6, 2015

(65) Prior Publication Data

US 2015/0224785 A1 Aug. 13, 2015

(30) Foreign Application Priority Data

Feb. 10, 2014 (JP) ..... 2014-023762

(51) Int. Cl.
*B41J 2/175* (2006.01)

(52) U.S. Cl.
CPC ..... *B41J 2/17596* (2013.01); *B41J 2/17503* (2013.01)

(58) Field of Classification Search
CPC .... B41J 2/175; B41J 2/17503; B41J 2/17596; Y10T 137/7913; Y10T 137/7934; Y10T 137/7935
USPC ..... 347/84, 85, 86
See application file for complete search history.

(56) References Cited

U.S. PATENT DOCUMENTS

| | | | | |
|---|---|---|---|---|
| 6,390,611 | B1 * | 5/2002 | Kobayashi et al. | 347/84 |
| 7,566,120 | B2 * | 7/2009 | Ishizawa et al. | 347/86 |
| 8,141,999 | B2 * | 3/2012 | Takagi | 347/86 |
| 2005/0088497 | A1 | 4/2005 | Katayama et al. | |

FOREIGN PATENT DOCUMENTS

JP 4506301 B2 7/2010

* cited by examiner

*Primary Examiner* — Anh T. N. Vo
(74) *Attorney, Agent, or Firm* — Banner & Witcoff, Ltd.

(57) ABSTRACT

A liquid cartridge includes: a valve chamber; a moving member; first and second sealing parts; and a second liquid channel. The valve chamber is defined by a side wall surface including central, first-end side, and second-end side regions. The central region defines a first space having a first cross-sectional area. The first-end side region defines a second space having a second cross-sectional area. The second-end side region defines a third space having a third cross-sectional area. The second and third cross-sectional areas are greater than the first cross-sectional area. The moving member moves from a first position where the first and second sealing parts are positioned within the first and third spaces, respectively, and the valve closes the second liquid channel, to a second position where the first and second sealing parts are positioned within the second and first spaces, respectively, and the valve opens the second liquid channel.

12 Claims, 7 Drawing Sheets

82
83
81
70A
70B
190
170
80
76
77
102B
47
86
85
84
88
69
102A
102
68
66
67
145
51
53
175
74
63
64
72
71
61
60
73
78
79
46A
46B
46C 82
83
81
70A
70B
190
170
80
76
77
102B
47
86
85
84
88
69
102A
102
68
66
67
145
51
53
175
74
64
63
72
71
61
60
73
78
79
46A
46B
46C 82
81
70A
70B
190
170
80
76
77
74
47
86
85
84
88
79
69
68
66
67
145
51
53
83
63
64
175
72
61
60
71
73
78
46A
46B
46C 82
81
70A
70B
190
170
80
76
77
102B
47
86
85
84
88
69
102A
102
68
66
67
145
51
53
83
63
64
175
72
61
60
71
74
73
78
79
46A
46B
46C

LIQUID CARTRIDGE CAPABLE OF REDUCING FORCE REQUIRED TO OPEN AIR CHANNEL AND LIQUID CHANNEL

CROSS REFERENCE TO RELATED APPLICATION

This application claims priority from Japanese Patent Application No. 2014-023762 filed Feb. 10, 2014. The entire content of the priority application is incorporated herein by reference.

TECHNICAL FIELD

The present invention relates to a liquid cartridge that supplies liquid stored therein.

BACKGROUND

An inkjet recording device well known in the art records images on paper by ejecting ink stored in an ink cartridge onto the paper through nozzles formed in a recording head. As an ink cartridge that is mounted in such an inkjet recording device, an ink cartridge including a single valve mechanism for opening and closing both an ink channel and an air channel has been known.

With this ink cartridge, an ink delivery tube inserted into a through-hole formed in a tubular member moves a valve element against a frictional force generated between the ink delivery tube and the tubular member and also against an urging force of a coil spring, thereby opening the ink channel. Further, the ink delivery tube moves the tubular member against a frictional force generated between the tubular member and a wall surface defining a large diameter hole and also against the urging force of the coil spring, thereby opening the air channel.

SUMMARY

In this case, when mounting the above-described ink cartridge in an inkjet recording device, a user is required to exert a force larger than the sum of the frictional force generated between the tubular member and the wall surface defining the large diameter hole and the urging force of the coil spring in order to push the ink cartridge into the inkjet recording device. That is, the above-described configuration requires a relatively large force for opening the air channel and the ink channel.

In view of the foregoing, it is an object of the present invention to provide a liquid cartridge having a configuration capable of reducing a force required to open an air channel and a liquid channel.

In order to attain the above and other objects, the present invention provides a liquid cartridge that may include: a liquid chamber; a valve chamber; a moving member; a first sealing part; a second sealing part; a first air channel; a second air channel; a first liquid channel; and a second liquid channel. The liquid chamber may be configured to store liquid therein. The valve chamber may be defined by a side wall surface and a base wall surface. The side wall surface may extend in a first direction away from the liquid chamber and may have an annular shape in cross-section taken along a plane orthogonal to the first direction. The side wall surface may have a first end at which the base wall surface is provided and a second end which is an open end and positioned downstream of the first end in the first direction. The side wall surface may have a first opening and a second opening. One of the side wall surface and the base wall surface may have a third opening at a position upstream of the first opening and the second opening in the first direction. The moving member may be disposed in the valve chamber and configured to move in a second direction opposite to the first direction. The moving member may have an outer surface and a through-hole. The through-hole may be configured to allow communication between a space in the valve chamber near the first end of the side wall surface and a space in the valve chamber near the second end of the side wall surface. The first sealing part may have an annular shape and be provided on the outer surface of the moving member. The second sealing part may have an annular shape and be provided on the outer surface of the moving member at a position downstream of the first sealing part in the first direction. The first air channel may be configured to provide communication between the valve chamber and an atmosphere through the first opening. The second air channel may be configured to allow air to flow between the valve chamber and the liquid chamber through the second opening. The first liquid channel may be configured to allow liquid to flow between the valve chamber and the liquid chamber through the third opening. The second liquid channel may extend from the third opening to the second end of the side wall surface through the through-hole formed in the moving member. The side wall surface may include: a central region; a first-end side region; and a second-end side region. The first opening may be formed in the central region. The first sealing part and the second sealing part may be configured to intimately contact the central region along its entire circumference to provide airtight seal. The central region may define a first internal space having a first cross-sectional area taken along a plane orthogonal to the first direction. The second opening may be formed in the first-end side region. The first-end side region may be positioned upstream of the central region in the first direction. The first-end side region may define a second internal space having a second cross-sectional area taken along a plane orthogonal to the first direction. The second-end side region may be positioned downstream of the central region in the first direction. The second-end side region may define a third internal space having a third cross-sectional area taken along a plane orthogonal to the first direction. The second cross-sectional area may be greater than the first cross-sectional area, and the third cross-sectional area may be greater than the first cross-sectional area. The moving member may include a valve configured to close and open the second liquid channel. The moving member may be configured to move from a first position to a second position closer to the first end of the side wall surface than the first position to the first end of the side wall surface. In the first position, the first sealing part may be positioned within the first internal space surrounded by the central region at a position upstream of the first opening in the first direction, the second sealing part may be positioned within the third internal space surrounded by the second-end side region, and the valve may close the second liquid channel. In the second position, the first sealing part may be positioned within the second internal space surrounded by the first-end side region to provide communication between the first opening and the second opening, the second sealing part may be positioned within the first internal space surrounded by the central region at a position downstream of the first opening in the first direction, and the valve may open the second liquid channel.

According to another aspect of the present invention, the present invention provides a liquid cartridge that may include: a liquid chamber; a valve chamber; a moving member; a first air channel; a second air channel; a first liquid channel; and a second liquid channel; a valve. The liquid chamber may be configured to store liquid therein. The valve chamber may be defined by a side wall surface and a base wall surface. The side wall surface may extend in a first direction away from the liquid chamber and have an annular shape in cross-section taken along a plane orthogonal to the first direction. The side wall surface may have a first end at which the base wall surface is provided and a second end which is an open end and positioned downstream of the first end in the first direction. The side wall surface may have a first opening and a second opening. One of the side wall surface and the base wall surface may have a third opening at a position upstream of the first opening and the second opening in the first direction. The side wall surface may include: a central region; a first-end side region; and a second-end side region. The first opening may be formed in the central region. The central region may define a first internal space having a first cross-sectional area taken along a plane orthogonal to the first direction. The second opening may be formed in the first-end side region. The first-end side region may be positioned upstream of the central region in the first direction. The first-end side region may define a second internal space having a second cross-sectional area taken along a plane orthogonal to the first direction. The second-end side region may be positioned downstream of the central region in the first direction. The second-end side region may define a third internal space having a third cross-sectional area taken along a plane orthogonal to the first direction. The second cross-sectional area may be greater than the first cross-sectional area, and the third cross-sectional area may be greater than the first cross-sectional area. The moving member may be movably disposed in the valve chamber and configured to move in a second direction opposite to the first direction. The moving member may include: a cylindrical part; a first sealing part; a second sealing part; and a valve seat. The cylindrical part may have an outer surface and a through-hole. The first sealing part may have an annular shape and protrude outward from the outer surface. The second sealing part may have an annular shape and protrude outward from the outer surface at a position downstream of the first sealing part in the first direction. The first sealing part and the second sealing part may be configured to intimately contact the central region along its entire circumference to provide airtight seal. The valve seat may be provided in the through hole. The first air channel may be configured to provide communication between the valve chamber and an atmosphere through the first opening. The second air channel may be configured to allow air to flow between the valve chamber and the liquid chamber through the second opening. The first liquid channel may be configured to allow liquid to flow between the valve chamber and the liquid chamber through the third opening. The second liquid channel may extend from the third opening to the second end of the side wall surface through the through-hole. The valve may be configured to be seated on and separated from the valve seat to close and open the second liquid channel. The moving member may be configured to move from a first position to a second position closer to the first end of the side wall surface than the first position to the first end of the side wall surface. In the first position, the first sealing part may be positioned within the first internal space surrounded by the central region at a position upstream of the first opening in the first direction, the second sealing part may be positioned within the third internal space surrounded by the second-end side region, and the valve may close the second liquid channel. In the second position, the first sealing part may be positioned within the second internal space surrounded by the first-end side region to provide communication between the first opening and the second opening, the second sealing part may be positioned within the first internal space surrounded by the central region at a position downstream of the first opening in the first direction, and the valve may open the second liquid channel.

BRIEF DESCRIPTION OF THE DRAWINGS

In the drawings;

FIGS. 5A through 5C are enlarged cross-sectional views of the valve chamber in a horizontal cross-section of the ink cartridge according to the embodiment as viewed from a top side thereof, in which FIG. 5A shows the moving member in a first position; FIG. 5B shows a valve constituting the moving member moved into an open position; and FIG. 5C shows the moving member in a second position;

FIGS. 6A through 6D are enlarged cross-sectional views of a valve chamber in a horizontal cross-section of an ink cartridge according to a first modification as viewed from a top side thereof, in which FIG. 6A shows a moving member in a first position; FIG. 6B shows a valve constituting the moving member moved into an open position; FIG. 6C shows the moving member in a third position; and FIG. 6D shows the moving member in a second position; and FIGS. 7A through 7C are enlarged cross-sectional views of a valve chamber in a horizontal cross-section of an ink cartridge according to a second modification as viewed from a top side thereof, in which FIG. 7A shows a moving member in a first position; FIG. 7B shows the moving member in a third position; and FIG. 7C shows the moving member in a second position.

DETAILED DESCRIPTION

Figure 1:
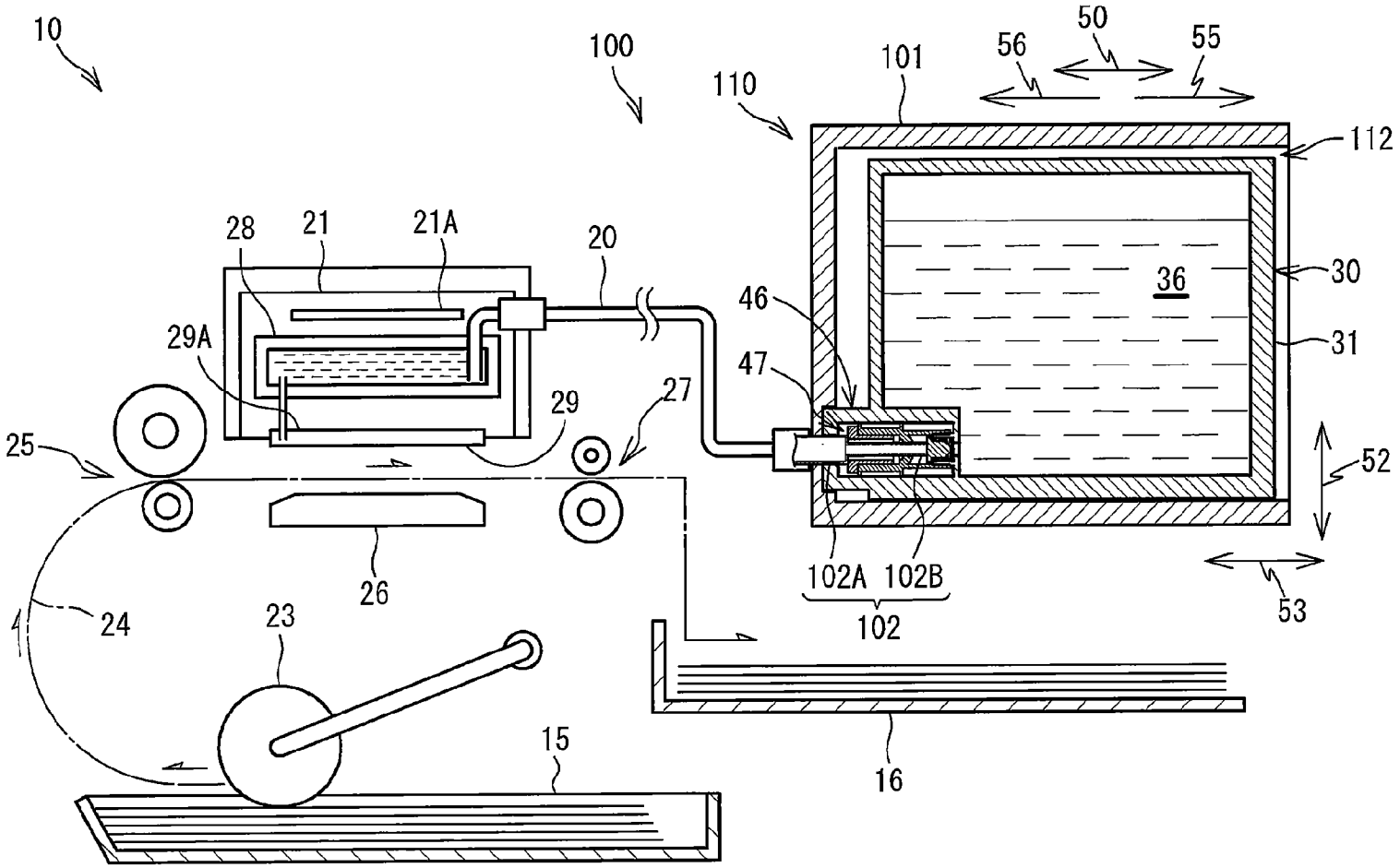
FIG. 1 is a schematic cross-sectional diagram illustrating an internal structure of a printer provided with a cartridge-mounting unit according to one embodiment of the present invention.

An ink cartridge 30 according to one embodiment of the present invention and a printer 10 configured to accommodate the ink cartridge 30 will be described with reference to FIGS. 1 through 5C, wherein like parts and components are designated by the same reference numerals to avoid duplicating description.

<Overall Structure of Printer 10>

The printer 10 employs an inkjet recording system for recording images on recording paper by selectively ejecting ink droplets toward the paper. As shown in FIG. 1, the printer 10 includes a recording head 21, an ink-supplying device 100, and an ink tube 20 connecting the recording head 21 to the ink-supplying device 100.

The ink-supplying device 100 is provided with a cartridge-mounting unit 110. The ink cartridge 30 (an example of a liquid cartridge) can be mounted in the cartridge-mounting unit 110.

An opening 112 is formed in one side of the cartridge-mounting unit 110. The ink cartridge 30 can be inserted into the cartridge-mounting unit 110 through the opening 112 in a mounting direction 56 (an example of a first direction) and can be extracted from the cartridge-mounting unit 110 through the opening 112 in a removing direction 55 (an example of a second direction).

The ink cartridge 30 is configured to store ink (an example of liquid) that the printer 10 can use in image formation. The ink tube 20 connects the ink cartridge 30 to the recording head 21 when the ink cartridge 30 is completely mounted in the cartridge-mounting unit 110.

The recording head 21 is provided with a sub-tank 28, and nozzles 29. The sub-tank 28 temporarily holds ink that is supplied through the ink tube 20. The recording head 21 selectively ejects ink supplied from the sub-tank 28 from the nozzles 29 according to an inkjet recording method. More specifically, the recording head 21 is provided with a head control board 21A, and piezoelectric elements 29A corresponding to each of the nozzles 29. The head control board 21A selectively applies drive voltages to the piezoelectric elements 29A to selectively eject ink from the nozzles 29.

The printer 10 has a paper-conveying mechanism that includes a paper tray 15, a feeding roller 23, a conveying path 24, a pair of conveying rollers 25, a platen 26, a pair of discharge rollers 27, and a discharge tray 16. The feeding roller 23 feeds recording paper from the paper tray 15 onto the conveying path 24, and the conveying rollers 25 convey the recording paper over the platen 26. The recording head 21 selectively ejects ink onto the recording paper as the recording paper passes over the platen 26, whereby an image is recorded on the recording paper. The discharge rollers 27 receive the recording paper that has passed over the platen 26 and discharge the recording paper onto the discharge tray 16 provided on the downstream end of the conveying path 24.

<Ink-Supplying Device 100>

As shown in FIG. 1, the ink-supplying device 100 is provided in the printer 10. The ink-supplying device 100 functions to supply ink to the recording head 21 provided in the printer 10. The ink-supplying device 100 includes the cartridge-mounting unit 110 in which the ink cartridge 30 can be mounted. The cartridge-mounting unit 110 includes a case 101, and an ink needle 102. FIG. 1 shows the state of the ink cartridge 30 when the ink cartridge 30 is completely mounted in the cartridge-mounting unit 110. Note that, while the cartridge-mounting unit 110 is provided with four ink needles 102 and can accommodate four ink cartridges 30 corresponding to the four colors cyan, magenta, yellow, and black, the following description will be concerned with the mutual operations of one ink needle 102 and the corresponding ink cartridge 30.

<Ink Needle 102>

The opening 112 is formed in the case 101. The case 101 has an inner back surface positioned on the opposite side of the case 101 from the opening 112. As shown in FIG. 1, the ink needle 102 protrudes in the removing direction 55 from the inner back surface of the case 101. The ink needle 102 is disposed on the inner back surface of the case 101 at a position for confronting a cylindrical wall 46 (described later) provided in the ink cartridge 30.

The ink needle 102 is a tube-like needle formed of resin. The ink needle 102 has a liquid channel in the center of the tube that runs along the longitudinal dimension of the ink needle 102. The ink needle 102 has a protruding end (i.e. an end that protrudes farthest from the inner back surface of the cartridge-mounting unit 110) formed with an opening, and a base end (opposite to the protruding end) connected to the ink tube 20.

When the ink needle 102 is inserted into the cylindrical wall 46 (described later) to be positioned inside the cylindrical wall 46, ink in an ink chamber 36 (an example of a liquid chamber) described later flows through a valve chamber 47 (described later) formed inside the cylindrical wall 46 into the ink tube 20 connected to the ink needle 102. Note that the definition of "needle" in this specification is a generic term that should include the meaning of a narrow tube-like member and need not be a member with a pointed tip.

<Ink Cartridge 30>

Figure 2A:
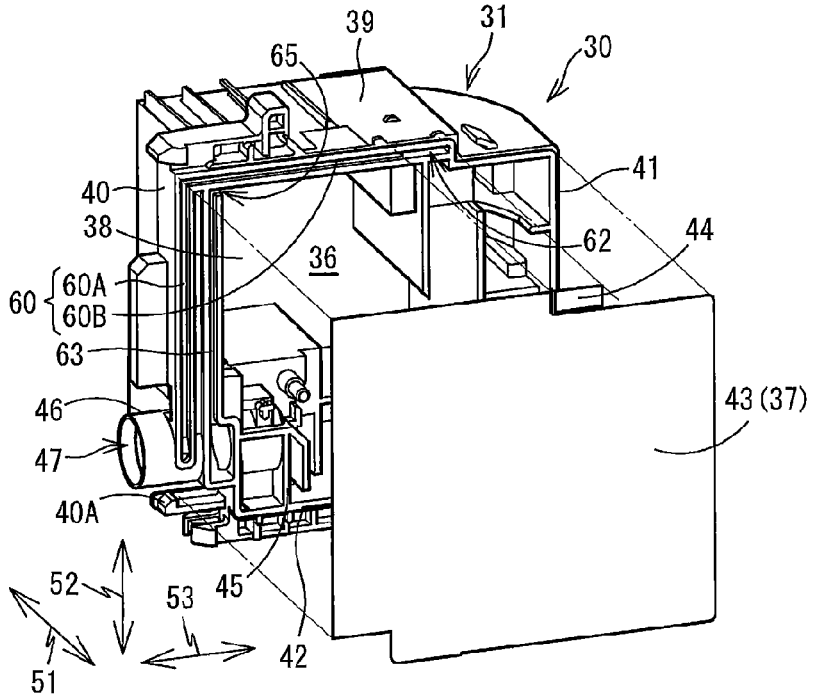
FIG. 2A is a perspective view showing a structure of an ink cartridge according to the embodiment as viewed from an upper front right side thereof.
Figure 2B:
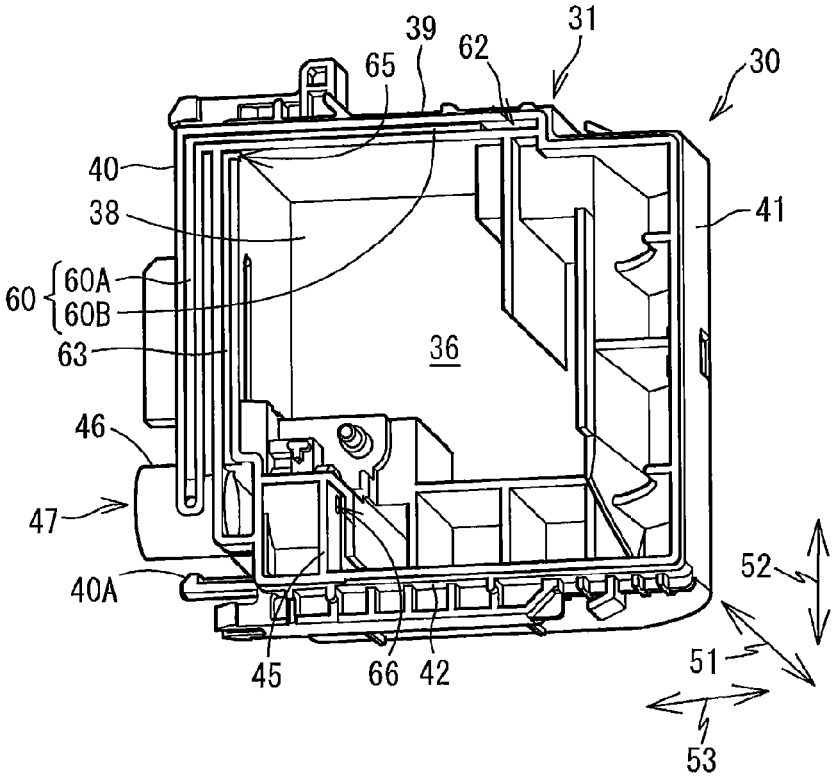
FIG. 2B is a perspective view showing the structure of the ink cartridge according to the embodiment as viewed from a lower rear right side thereof.

As shown in FIGS. 2A and 2B, the ink cartridge 30 includes a frame 31, and the cylindrical wall 46. The ink chamber 36 is formed inside the frame 31, and the valve chamber 47 (see FIGS. 5A through 5C) is formed inside the cylindrical wall 46. The ink cartridge 30 supplies ink stored in the ink chamber 36 externally through the valve chamber 47. The ink cartridge 30 is inserted in and extracted from the cartridge-mounting unit 110 along the mounting and removing directions 50 while in an erected state shown in FIGS. 2A and 2B, i.e., with a bottom surface of the ink cartridge 30 in FIGS. 2A and 2B positioned on the bottom and a top surface of the ink cartridge 30 in FIGS. 2A and 2B positioned on the top. The mounting and removing directions 50 are horizontal directions in the present embodiment. Further, a widthwise direction 51 and a depthwise direction 53 with respect to the ink cartridge 30 are also horizontal when the ink cartridge 30 is in its erected state. A heightwise direction 52 with respect to the ink cartridge 30 in its erected state is aligned with the direction of gravity (vertical). The removing direction 55 and the mounting direction 56 correspond to the mounting and removing directions 50 and are opposing directions to each other. The mounting and removing directions 50 are also aligned with the depthwise direction 53.

<Frame 31>

The frame 31 has an external shape similar to a rectangular parallelepiped that appears flattened in the widthwise direction (left-right direction) 51 so that the dimension of the frame 31 in the widthwise direction 51 is small and the dimensions of the frame 31 in the heightwise direction (top-bottom direction) 52 and the depthwise direction (front-rear direction) 53 are greater than the dimension of the frame 31 in the widthwise direction 51.

The frame 31 is configured of a front wall 40 and a rear wall 41 that at least partially overlap each other when projected in the depthwise direction 53, a top wall 39 and a bottom wall 42 that at least partially overlap each other when projected in the heightwise direction 52, and a left wall 38 disposed on one side of the frame 31 with respect to the widthwise direction 51 (on the left side of the frame 31 when viewing the frame 31 from the front wall 40 side in FIGS. 2A and 2B). The front wall 40 is the side of the frame 31 facing forward when the ink cartridge 30 is mounted in the cartridge-mounting unit 110, while the rear wall 41 faces rearward. The frame 31 is formed of a resin material, for example.

The top wall 39 is connected to top edges of the left wall 38, the front wall 40 and the rear wall 41. The bottom wall 42 is connected to bottom edges of the left wall 38, the front wall 40, and the rear wall 41. The left wall 38 is connected to left edges of the top wall 39, the front wall 40, the rear wall 41, and the bottom wall 42. The side of the frame 31 opposite the left wall 38 in the widthwise direction 51 (the right side of the frame 31 when viewing the frame 31 from the front wall 40 side in FIGS. 2A and 2B) is open. This open side of the frame 31 is sealed by a film 43.

The film 43 has an outer shape substantially equal to the outer shape of the frame 31 when viewed in the widthwise direction 51. The film 43 is disposed on the side of the frame 31 opposite the left wall 38 in the widthwise direction 51 (the right side) and constitutes a right wall 37 of the ink chamber 36 with respect to the widthwise direction 51. The film 43 is heat-sealed to the right end faces of the top wall 39, the front wall 40, the rear wall 41, and the bottom wall 42. The resulting ink chamber 36 defined by the left wall 38, the top wall 39, the front wall 40, the rear wall 41, the bottom wall 42, and the film 43 can store ink.

<Valve Chamber 47>

Figure 5A:
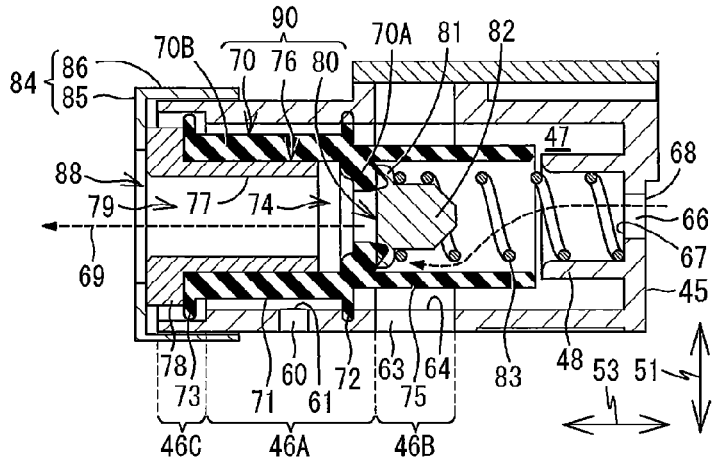
Figure 5B:
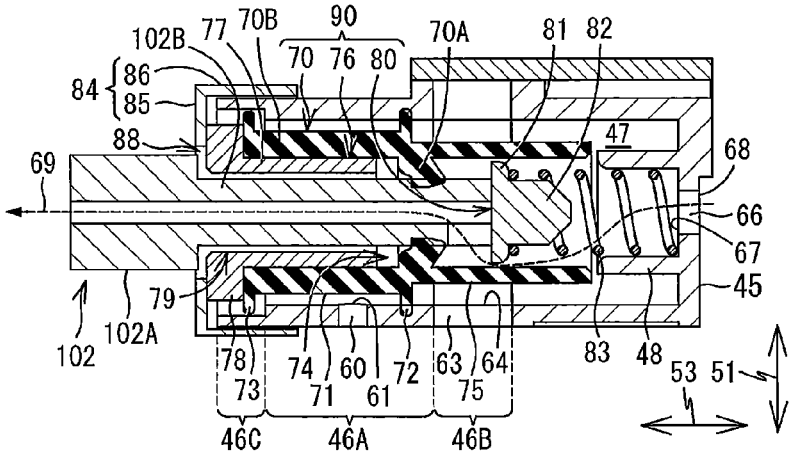
Figure 5C:
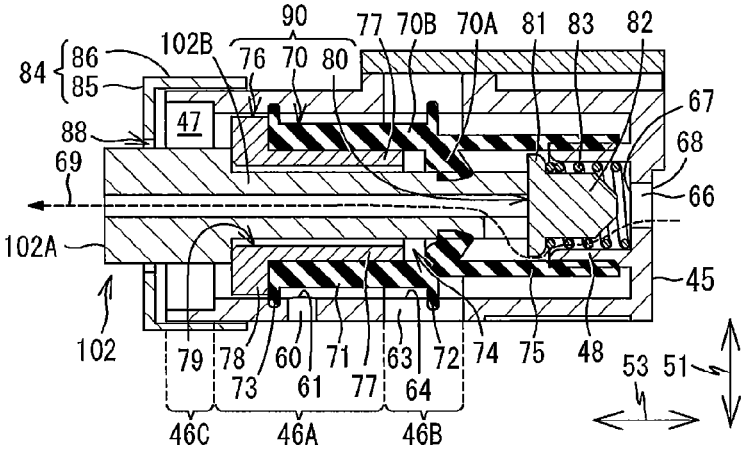

As shown in FIGS. 2A, 2B, and 5A through 5C, the ink cartridge 30 also includes a proximal wall 45 disposed on the end of the cylindrical wall 46 positioned inside the frame 31. The valve chamber 47 is a space defined by a front surface of the proximal wall 45 and an inner peripheral surface of the cylindrical wall 46. As shown in FIGS. 1, 2A and 2B, the valve chamber 47 is provided on a front portion of the ink cartridge 30 in the depthwise direction 53 and near a bottom portion of the ink cartridge 30 in the heightwise direction 52. The proximal wall 45 and the cylindrical wall 46 are formed of a resin material, for example. The valve chamber 47 is connected to a first air channel 60, a second air channel 63, and a first liquid channel 66. Further, as shown in FIGS. 5A through 5C, a second liquid channel 69 is formed inside the cylindrical wall 46. A seal member 70, a reinforcement member 76, a valve 80, and a coil spring 83 (an example of an urging member) are accommodated within the cylindrical wall 46. A cap 84 is attached to the distal end of the cylindrical wall 46.

As shown in FIGS. 2A and 2B, the proximal wall 45 is disposed between the ink chamber 36 and the valve chamber 47 that are adjacent to each other in the depthwise direction 53. The cylindrical wall 46 extends forward from the front surface of the proximal wall 45. In other words, the cylindrical wall 46 extends from the front surface of the proximal wall 45 in the mounting direction 56 toward the outside of the ink cartridge 30. A front end of the cylindrical wall 46 protrudes forward from the front wall 40, while a rear end of the cylindrical wall 46 is positioned rearward of the front wall 40. The proximal end of the cylindrical wall 46 (an upstream end in the mounting direction 56; an example of a first end) is connected to the proximal wall 45, and the distal end of the cylindrical wall 46 (a downstream end in the mounting direction 56; an example of a second end) is open.

The inner peripheral surface of the cylindrical wall 46 is formed continuously in a cross-section orthogonal to the mounting direction 56, i.e., is annular. Here, "annular" is not limited to a circular shape, but may be elliptical, rectangular, or the like. The "annular" shape may also imply a loop or an endless shape. The inner peripheral surface of the cylindrical wall 46 is an example of an annular side wall surface. The front surface of the proximal wall 45 is an example of a base wall surface. Therefore, the proximal end of the cylindrical wall 46 serving as an example of a first end indicates the upstream end in the mounting direction 56 on the inner peripheral surface of the cylindrical wall 46. The distal end of the cylindrical wall 46 serving as an example of a second end indicates the downstream end in the mounting direction 56 on the inner peripheral surface of the cylindrical wall 46.

As shown in FIGS. 5A through 5C, the inner peripheral surface of the cylindrical wall 46 includes a central region 46A, a proximal-end side region 46B (an example of a first-end side region), and a distal-end side region 46C (an example of a second-end side region). The central region 46A is positioned between the proximal-end side region 46B and the distal-end side region 46C in the depthwise direction 53 (in the mounting and removing directions 50). In other words, the proximal-end side region 46B is positioned closer to the proximal end of the cylindrical wall 46 than the central region 46A is to the proximal end of the cylindrical wall 46, and the distal-end side region 46C is positioned closer to the distal end of the cylindrical wall 46 than the central region 46A is to the distal end of the cylindrical wall 46.

The inner diameter of the central region 46A is smaller than the inner diameter of the proximal-end side region 46B, and smaller than the inner diameter of the distal-end side region 46C. In other words, the inner diameter of the proximal-end side region 46B is larger than the inner diameter of the central region 46A, and the inner diameter of the distal-end side region 46C is larger than the inner diameter of the central region 46A. In other words, the cross-sectional area taken orthogonal to the mounting direction 56 of the internal space surrounded by the proximal-end side region 46B is larger than the cross-sectional area taken orthogonal to the mounting direction 56 of the internal space surrounded by the central region 46A. Further, the cross-sectional area taken orthogonal to the mounting direction 56 of the internal space surrounded by the distal-end side region 46C is larger than the cross-sectional area taken orthogonal to the mounting direction 56 of the internal space surrounded by the central region 46A.

The first air channel 60 allows air to flow between the valve chamber 47 and the exterior of the ink cartridge 30. In other words, the first air channel 60 provides communication between the valve chamber 47 and ambient air (i.e. atmosphere). Referring to FIGS. 2A and 2B, the first air channel 60 includes a groove 60A and a groove 60B. The groove 60A is formed in a right endface of the front wall 40 and extends in the heightwise direction 52. The groove 60B is formed in a right endface of the top wall 39 and extends in the depthwise direction 53 so as to be connected with a top end of the groove 60A. A bottom end of the groove 60A is in communication with the valve chamber 47 through an opening 61 (an example of a first opening; also see FIGS. 5A through 5C) formed in the central region 46A of the inner peripheral surface (i.e., the side wall surface) of the cylindrical wall 46. A rear end of the groove 60B is in communication with the exterior of the ink cartridge 30 through an opening 62 formed in the right endface of the top wall 39.

The second air channel 63 allows air to flow between the valve chamber 47 and the ink chamber 36. The second air channel 63 is a groove formed in the right endface of the front wall 40 that extends in the heightwise direction 52. Further, a bottom end of the second air channel 63 is in communication with the valve chamber 47 through an opening 64 (an example of a second opening; also see FIGS. 5A through 5C) formed in the proximal-end side region 46B of the inner peripheral surface of the cylindrical wall 46. A top end of the second air channel 63 is in communication with the ink chamber 36 through an opening 65 formed in a rear surface of the front wall 40 (the surface on the ink chamber 36 side). As shown in FIGS. 5A through 5C, the opening 64 is positioned closer to the proximal end of the cylindrical wall 46 than the opening 61 is to the proximal end of the cylindrical wall 46. The opening 65 is positioned above the level of ink accommodated in the ink chamber 36 of the ink cartridge 30 that is still unused.

As shown in FIG. 2A, the first air channel 60 and the second air channel 63 are sealed liquid-tight by the film 43 constituting the right wall 37 of the ink cartridge 30. The opening 62 is also sealed by a semipermeable membrane 44. That is, a notch is formed in the film 43 at a position corresponding to the opening 62. The semipermeable membrane 44 is a porous membrane formed with microholes that allow the passage of air while preventing the passage of ink. For example, the semipermeable membrane 44 may be formed of a fluororesin, such as polytetrafluoroethylene, polychlorotrifluoroethylene, tetrafluoroethylene-hexafluoropropylene copolymer, tetrafluoroethylene-perfluoroalkylvinylether copolymer, or tetrafluoroethylene-ethylene copolymer.

As shown in FIGS. 2B, 5A through 5C, the first liquid channel 66 allows ink to flow between the valve chamber 47 and the ink chamber 36. In the present embodiment, the first liquid channel 66 is a through-hole that penetrates the proximal wall 45 in its thickness dimension (in the depthwise direction 53 or the mounting and removing directions 50). The first liquid channel 66 is in communication with the valve chamber 47 through an opening 67 (an example of a third opening) formed in the front surface (the surface on the valve chamber 47 side) of the proximal wall 45. Thus, the opening 67 is positioned toward the proximal end of the cylindrical wall 46 from the opening 61 and the opening 64. The first liquid channel 66 is in communication with the ink chamber 36 through an opening 68 formed in a rear surface (the surface on the ink chamber 36 side) of the proximal wall 45.

The seal member 70 includes a cylindrical part 71 having a cylindrical shape, and flange-like first and second sealing parts 72 and 73 that protrude radially outward from an outer circumferential surface of the cylindrical part 71. The seal member 70 is formed of a rubber or other elastic material, for example. The first sealing part 72 and the second sealing part 73 are spaced apart from each other in the depthwise direction 53. More specifically, the first sealing part 72 is provided closer to the proximal end of the cylindrical wall 46 than the second sealing part 73 is to the proximal end of the cylindrical wall 46, and thus conversely, the second sealing part 73 is provided closer to the distal end of the cylindrical wall 46 than the first sealing part 72 is to the distal end of the cylindrical wall 46. The seal member 70 moves in the depthwise direction 53 within the valve chamber 47. The first sealing part 72 and the second sealing part 73 slide along the inner peripheral surface of the cylindrical wall 46 as the seal member 70 moves in the valve chamber 47.

As shown in FIGS. 5A through 5C, the first sealing part 72 and the second sealing part 73 intimately contact the central region 46A of the inner peripheral surface of the cylindrical wall 46 along its entire circumference to respectively form airtight seals with the central region 46A. When the seal member 70 is not inserted into the valve chamber 47, the outer diameter of the first sealing part 72 and the outer diameter of the second sealing part 73 are larger than the inner diameter of the central region 46A of the inner peripheral surface of the cylindrical wall 46. In other words, when contacting the central region 46A of the inner peripheral surface of the cylindrical wall 46, the first sealing part 72 and the second sealing part 73 elastically deform inward in a direction that reduces their outer diameters. Thus, the space on the proximal side of the valve chamber 47 is shut off from the space on the distal side of the valve chamber 47 at the outside of the seal member 70.

Meanwhile, a gap is formed between the first and second sealing parts 72 and 73 and the proximal-end side region 46B of the inner peripheral surface of the cylindrical wall 46 in a circumferential direction thereof. Further, a gap is formed between the first and second sealing parts 72 and 73 and the distal-end side region 46C of the inner peripheral surface of the cylindrical wall 46 in a circumferential direction thereof. That is, the outer diameter of the first sealing part 72 and the outer diameter of the second sealing part 73 are smaller than the inner diameter of the proximal-end side region 46B, and also smaller than the inner diameter of the distal-end side region 46C.

A through-hole 74 is formed in the seal member 70 and penetrates the seal member 70 in the depthwise direction 53. The space on the proximal side of the valve chamber 47 is in communication with the space on the distal side of the valve chamber 47 through the through-hole 74. A channel extending from the opening 67 to the distal end of the cylindrical wall 46 through the through-hole 74 constitutes the second liquid channel 69. The second liquid channel 69 allows ink to flow inside the valve chamber 47.

The seal member 70 includes a small diameter part 70A (an example of a valve seat) and a large diameter part 70B. The inner diameter of the small diameter part 70A is smaller than the inner diameter of the large diameter part 70B. In other words, the diameter of the through-hole 74 in the small diameter part 70A is smaller than the diameter of the through-hole 74 in the large diameter part 70B. Moreover, in the depthwise direction 53, the dimension of the small diameter part 70A is smaller than the distance between the first sealing part 72 and the second sealing part 73. The seal member 70 is disposed within the valve chamber 47 such that the small diameter part 70A faces the proximal end of the cylindrical wall 46 and that the large diameter part 70B faces the distal end of the cylindrical wall 46.

The seal member 70 further includes a first cylindrical wall 75 having a cylindrical shape. The first cylindrical wall 75 protrudes at a position surrounding an opening (an example of a fourth opening) formed in the small diameter part 70A of the seal member 70 toward the proximal end of the cylindrical wall 46.

A second cylindrical wall 48 is provided on the proximal wall 45. The second cylindrical wall 48 protrudes at a position surrounding the opening 67 toward the distal end of the cylindrical wall 46. The second cylindrical wall 48 is fitted into the first cylindrical wall 75 so as to provide a liquid-tight seal, as shown in FIG. 5C. More specifically, the outer diameter of the second cylindrical wall 48 is slightly larger than the inner diameter of the first cylindrical wall 75. Thus, the first cylindrical wall 75 contacts the outer peripheral surface of the second cylindrical wall 48 and forms an liquid-tight seal with the outer peripheral surface of the second cylindrical wall 48.

The reinforcement member 76 includes a cylindrical part 77 having a cylindrical shape, and a flange part 78 that protrudes radially outward from one end (front end) of the cylindrical part 77. The reinforcement member 76 is formed of a material having greater rigidity than the seal member 70 (a resin material, for example). The reinforcement member 76 is disposed in the valve chamber 47, with the cylindrical part 77 facing the proximal end of the cylindrical wall 46 and the flange part 78 facing the distal end of the cylindrical wall 46. The reinforcement member 76 moves together with the seal member 70 inside the valve chamber 47 in the depthwise direction 53.

The outer diameter of the cylindrical part 77 is substantially equal to the inner diameter of the cylindrical part 71 in the large diameter part 70B. The cylindrical part 77 intimately contacts the inner peripheral surface of the large diameter part 70B that defines the through-hole 74. The outer diameter of the flange part 78 is larger than the inner diameter of the cylindrical part 71 of the seal member 70. The flange part 78 contacts an endface of the seal member 70 that faces the distal end of the cylindrical wall 46. A through-hole 79 is formed in the reinforcement member 76 and penetrates the cylindrical part 77 and the flange part 78. The diameter of the through-hole 79 is larger than the diameter of the through-hole 74 in the small diameter part 70A. The reinforcement member 76 is inserted into the seal member 70, thereby providing communication between the through-hole 74 and the through-hole 79.

The valve 80 includes a disc-shaped contact part 81, and a restriction part 82 that is provided on one surface (rear surface) of the contact part 81 so as to protrude therefrom. The valve 80 is formed of a resin material, for example. The valve 80 is disposed within the valve chamber 47, with the contact part 81 facing the distal end of the cylindrical wall 46 and the restriction part 82 facing the proximal end of the cylindrical wall 46. More specifically, the valve 80 is disposed inside the first cylindrical wall 75. The contact part 81 moves toward and away from a peripheral edge defining the opening of the through-hole 74 on the small diameter part 70A side (i.e. the opening of the small diameter part 70A facing the proximal wall 45). The restriction part 82 is inserted into the coil spring 83, thereby restricting positional displacement between the valve 80 and the coil spring 83.

The valve 80 is configured to move in the depthwise direction 53 with respect to the seal member 70 between a closed position (see FIG. 5A) and an open position (see FIGS. 5B and 5C). In the closed position, a front surface of the contact part 81 contacts and forms a liquid-tight seal with the peripheral edge defining the opening of the small diameter part 70A to close the through-hole 74. In the open position, the front surface of the contact part 81 is separated from the small diameter part 70A to open the through-hole 74. The seal member 70, the reinforcement member 76, and the valve 80 at times move independently inside the valve chamber 47 in the depthwise direction 53, and at other times move together inside the valve chamber 47 in the depthwise direction 53. The seal member 70, the reinforcement member 76, and the valve 80 constitute a moving member 90. The moving member 90 is movably disposed in the valve chamber 47.

The coil spring 83 is disposed between the proximal wall 45 and the valve 80. More specifically, one end of the coil spring 83 contacts the front surface of the proximal wall 45, and the other end contacts the rear surface of the contact part 81 at a position surrounding the restriction part 82. The coil spring 83 urges the valve 80 toward the distal end of the cylindrical wall 46. Incidentally, a leaf spring or other urging member may be used in place of the coil spring 83.

Figure 3:
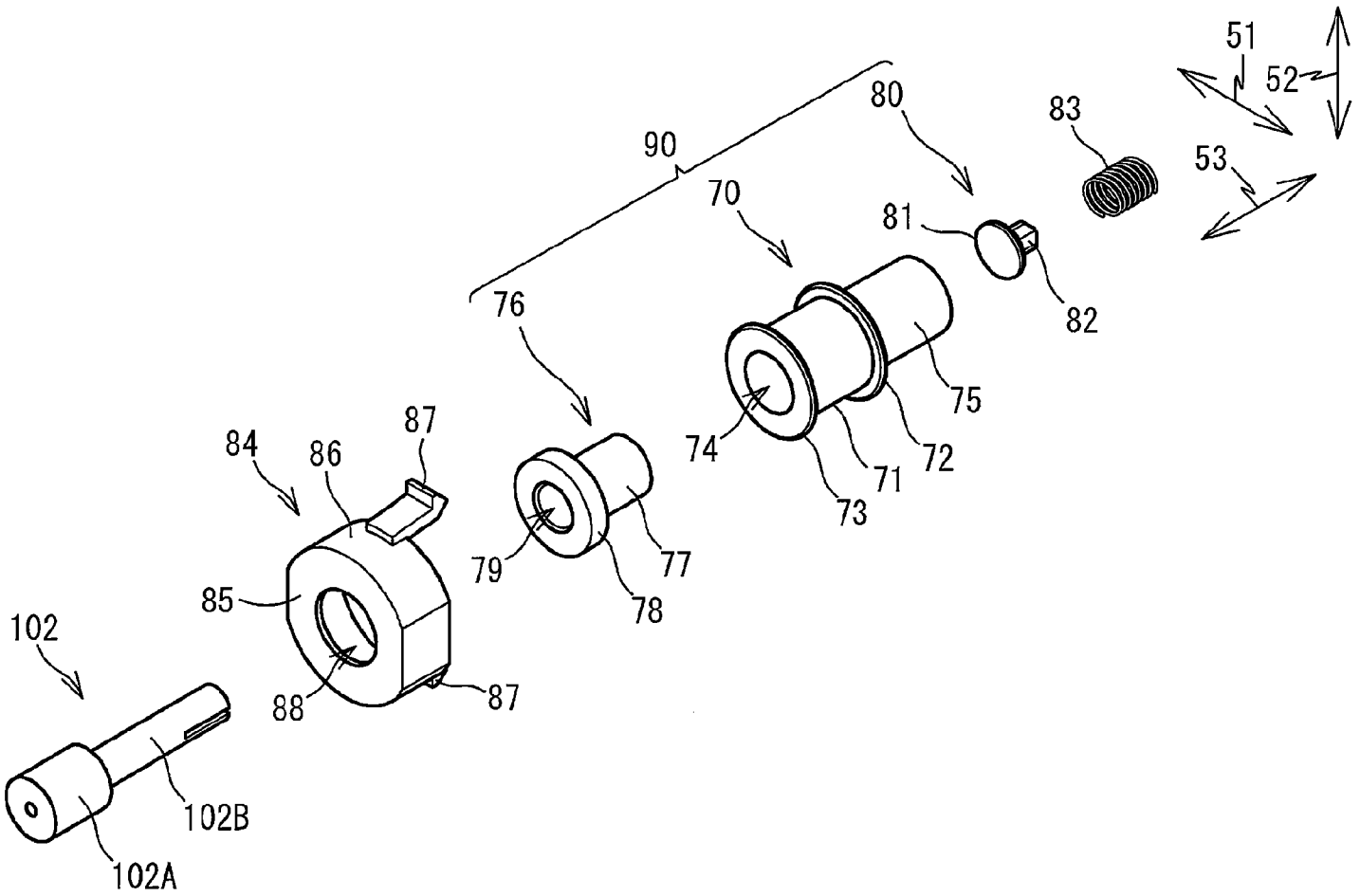
FIG. 3 is an exploded perspective view showing components that function to open and close a valve chamber in the ink cartridge according to the embodiment as viewed from a front side thereof, the components including a moving member.
Figure 4:
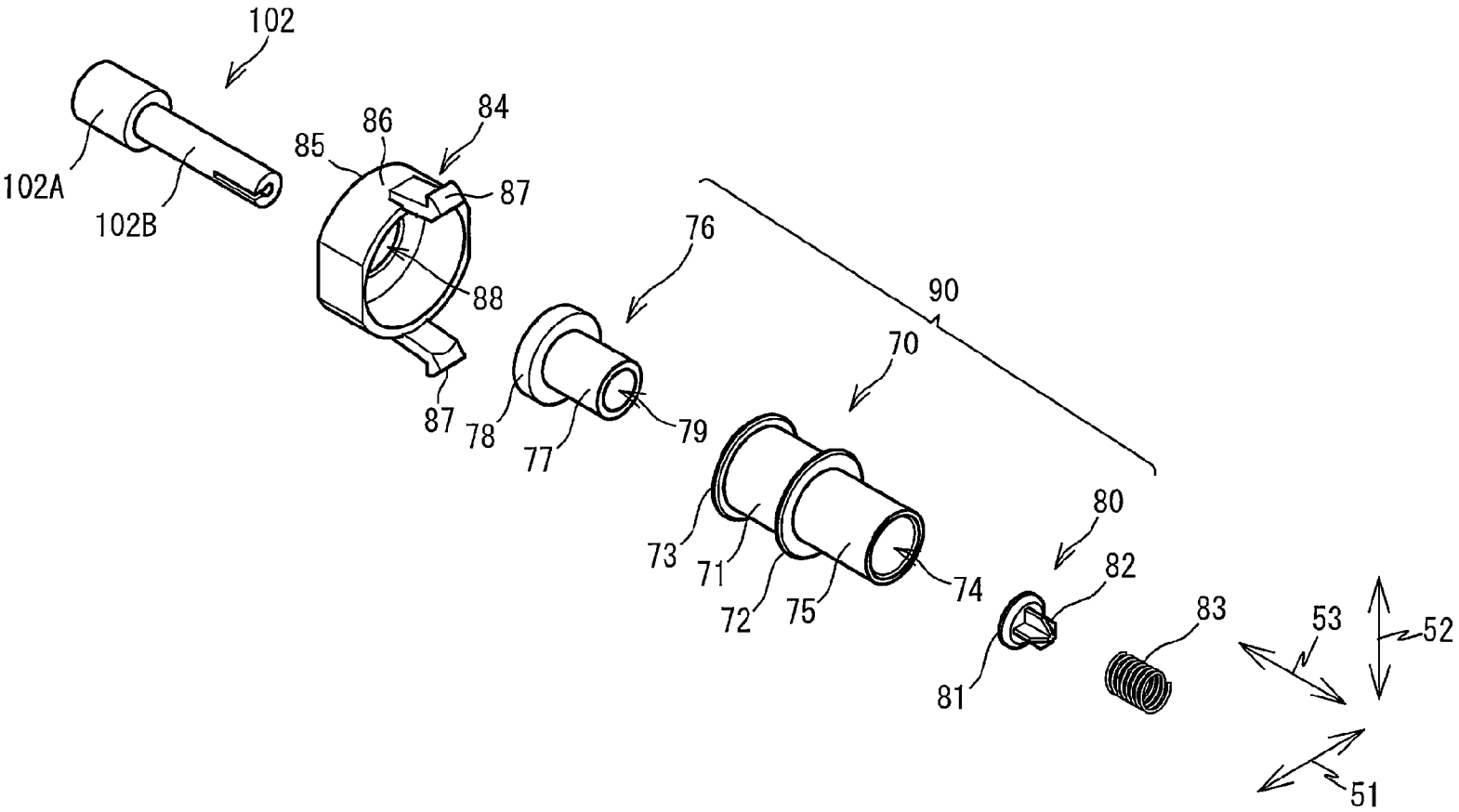
FIG. 4 is an exploded perspective view showing the components that function to open and close the valve chamber in the ink cartridge according to the embodiment as viewed from a rear side thereof.

As shown in FIGS. 3 and 4, the cap 84 includes a disc-shaped cover part 85, a cylindrical part 86 having a cylindrical shape and protruding from one surface (rear surface) of the cover part 85 in its thickness dimension (i.e. in the depthwise direction 53 or the mounting and removing directions 50), and engaging parts 87 protruding away from the cover part 85 from a protruding edge of the cylindrical part 86. The cap 84 is formed of a resin material, for example. As shown in FIGS. 5A through 5C, the cylindrical part 86 covers a portion on the outer peripheral surface of the cylindrical wall 46. The engaging parts 87 engage with engaged parts 40A (see FIGS. 2A and 2B) provided on the front wall 40. A through-hole 88 is formed in the cover part 85 and penetrates a center region of the cover part 85 in its thickness dimension. The diameter of the through-hole 88 is smaller than the outer diameter of the flange part 78 of the reinforcement member 76. The cylindrical part 86 is provided to surround the through-hole 88.

As shown in FIGS. 3 through 5C, the ink needle 102 includes a thick tube part 102A that protrudes from the inner back surface of the case 101 in the removing direction 55, and a narrow tube part 102B that protrudes from a distal end (rear end) of the thick tube part 102A in the removing direction 55. The outer diameter of the narrow tube part 102B is smaller than the outer diameter of the thick tube part 102A. As shown in FIGS. 5B and 5C, the outer diameter of the thick tube part 102A is smaller than the diameter of the through-hole 88 formed in the cap 84, and larger than the diameter of the through-hole 79 formed in the reinforcement member 76. That is, the distal end of the thick tube part 102A contacts the flange part 78 of the reinforcement member 76.

The outer diameter of the narrow tube part 102B is smaller than the diameter of the through-hole 88 formed in the cap 84 and also smaller than the diameter of the through-hole 79 formed in the reinforcement member 76. Further, the outer diameter of the narrow tube part 102B is slightly larger than the inner diameter of the small diameter part 70A. In other words, the narrow tube part 102B can be inserted into the seal member 70 through the through-holes 88 and 79 and pressed against the small diameter part 70A. More specifically, the narrow tube part 102B contacts the inner circumferential surface of the small diameter part 70A defining the through-hole 74, causing the inner circumferential surface of the small diameter part 70A to elastically deform in a radial direction thereof, and a distal end (rear end) of the narrow tube part 102B contacts the front surface of the valve 80.

Next, the movement of the moving member 90 during the process of mounting the ink cartridge 30 in the cartridge-mounting unit 110 will be described with reference to FIGS. 5A through 5C. FIG. 5A shows the state of components in the valve chamber 47 before the ink cartridge 30 is mounted in the cartridge-mounting unit 110. FIG. 5B shows the state of components in the valve chamber 47 during the process of mounting the ink cartridge 30 in the cartridge-mounting unit 110 (during the process of inserting the ink needle 102 into the valve chamber 47). FIG. 5C shows the state of components in the valve chamber 47 after the ink cartridge 30 has been completely mounted in the cartridge-mounting unit 110 (in a state where ink can be supplied from the ink cartridge 30).

In the state shown in FIG. 5A, the seal member 70 constituting the moving member 90 is at a first position due to the urging force of the coil spring 83. The valve 80 is at the closed position due to the urging force of the coil spring 83. That is, the second liquid channel 69, indicated by an arrow in FIG. 5A, is closed at a position of the opening of the through-hole 74 on the small diameter part 70A side. The position of the moving member 90 shown in FIG. 5A is an example of a first position. Further, the front surface of the flange part 78 of the reinforcement member 76 is in contact with the rear surface of the cover part 85 of the cap 84, thereby blocking the moving member 90 from moving toward the distal end of the cylindrical wall 46 further from the position shown in FIG. 5A.

At this time, the first sealing part 72 is positioned in the internal space surrounded by the central region 46A of the inner peripheral surface of the cylindrical wall 46, and contacts and forms an airtight seal with the central region 46A along its entire circumference at a position toward the proximal end of the cylindrical wall 46 from the opening 61. With this arrangement, the first sealing part 72 interrupts communication between the first air channel 60 and the second air channel 63. Incidentally, as long as communication is interrupted between the first air channel 60 and the second air channel 63, the first sealing part 72 may be arranged to partially overlap with the opening 61. The second sealing part 73 is positioned in the internal space surrounded by the distal-end side region 46C of the inner peripheral surface of the cylindrical wall 46. Note that, in the present embodiment, since the distal-end side region 46C is spaced apart from the second sealing part 73, the positional relationship between the second sealing part 73 and the opening 61 is not specifically limited.

Next, in the state shown in FIG. 5B, the narrow tube part 102B of the ink needle 102 moves into the seal member 70 through the through-holes 88 and 79, passes through the small diameter part 70A, and presses the valve 80 toward the proximal end of the cylindrical wall 46. When being pressed by the distal end of the narrow tube part 102B, the valve 80 moves against the urging force of the coil spring 83 from the closed position to the open position. Hence, the second liquid channel 69 is opened. As a result, through the first liquid channel 66, the second liquid channel 69, and the ink needle 102, ink in the ink chamber 36 can flow out of the ink cartridge 30. At this time, the thick tube part 102A of the ink needle 102 is spaced apart from the flange part 78 of the reinforcement member 76.

Further, at this time, the narrow tube part 102B is inserted into the small diameter part 70A while being pressed against the small diameter part 70A. In other words, as the narrow tube part 102B is inserted into the small diameter part 70A, the small diameter part 70A elastically deforms in a direction that expands its inner diameter. As a result, the outer peripheral surface of the narrow tube part 102B contacts and forms a liquid-tight seal with the inner circumferential surface of the small diameter part 70A. According to the present embodiment, the seal member 70 is not moved in the depthwise direction 53 by the frictional force generated between the outer peripheral surface of the narrow tube part 102B and the inner circumferential surface of the small diameter part 70A. That is, the frictional force generated between the outer peripheral surface of the narrow tube part 102B and the inner circumferential surface of the small diameter part 70A is smaller than the frictional force generated between the first sealing part 72 and the central region 46A of the inner peripheral surface of the cylindrical wall 46.

Next, in the state shown in FIG. 5C, the distal end of the thick tube part 102A of the ink needle 102 pushes the flange part 78 of the reinforcement member 76 toward the proximal end of the cylindrical wall 46. When being pushed by the distal end of the thick tube part 102A, the seal member 70 and the reinforcement member 76 move against the urging force of the coil spring 83 toward the proximal end of the cylindrical wall 46. Further, the distal end of the narrow tube part 102B further presses the valve 80 toward the proximal end of the cylindrical wall 46. When being pressed by the distal end of the narrow tube part 102B, the valve 80 is moved together with the seal member 70 toward the proximal end of the cylindrical wall 46. As a result, the valve 80 shown in FIG. 5C is placed in the open position. The position of the moving member 90 shown in FIG. 5C is an example of a second position closer to the proximal end of the cylindrical wall 46 than in the first position.

At this time, the first sealing part 72 is positioned in the internal space surrounded by the proximal-end side region 46B of the inner peripheral surface of the cylindrical wall 46. Accordingly, the first air channel 60 communicates with the second air channel 63. As a result, the ink chamber 36 communicates with external air through the first air channel 60, the valve chamber 47, and the second air channel 63. Note that, in the present embodiment, the first sealing part 72 is spaced apart from the proximal-end side region 46B of the inner peripheral surface of the cylindrical wall 46. Therefore, the positional relationship between the first sealing part 72 and the opening 64 is not specifically limited.

Further, the second sealing part 73 is positioned in the internal space surrounded by the central region 46A of the inner peripheral surface of the cylindrical wall 46, and contacts and forms an airtight seal with the central region 46A along its entire circumference at a position toward the distal end of the cylindrical wall 46 from the opening 61. With this arrangement, the second sealing part 73 interrupts communication between the first and second air channels 60 and 63 and the opened distal end of the cylindrical wall 46. Incidentally, as long as communication is interrupted between the first and second air channels 60 and 63 and the distal end of the cylindrical wall 46, the second sealing part 73 may be arranged to partially overlap with the opening 61.

Note that, the timing at which the first sealing part 72 moves past a boundary between the central region 46A and the proximal-end side region 46B, and the timing at which the second sealing part 73 moves past a boundary between the distal-end side region 46C and the central region 46A are not specifically limited. As one example, when the moving member 90 is being moved from the first position to the second position, the first sealing part 72 and the second sealing part 73 may simultaneously intimately contact the central region 46A. As another example, when the moving member 90 is being moved from the first position to the second position, the second sealing part 73 may be placed into the internal space surrounded by the distal-end side region 46C at the same time when the first sealing part 72 is placed into the internal space surrounded by the proximal-end side region 46B.

Further, in the state where the moving member 90 is in the second position, the first cylindrical wall 75 is fitted with the second cylindrical wall 48. More specifically, the inner peripheral surface of the first cylindrical wall 75 contacts and forms liquid-tight seal with the outer peripheral surface of the second cylindrical wall 48. With this arrangement, communication is interrupted between the first and second air channels 60 and 63 and the first and second liquid channels 66 and 69.

Note that, the timing at which the first sealing part 72 moves past a boundary between the central region 46A and the proximal-end side region 46B, and the timing at which the first cylindrical wall 75 is fitted with the second cylindrical wall 48 are not specifically limited. As one example, the first cylindrical wall 75 may be fitted with the second cylindrical wall 48 at the timing when the first sealing part 72 is in intimate contact with the central region 46A. As another example, the first cylindrical wall 75 may be fitted with the second cylindrical wall 48 after the first sealing part 72 is moved into the internal space surrounded by the proximal-end side region 46B.

<Operational Advantages of the Embodiment>

According to the above-described embodiment, during the process of mounting the ink cartridge 30 in the cartridge-mounting unit 110, one of the first sealing part 72 and the second sealing part 73 is in close contact with the inner peripheral surface of the cylindrical wall 46, while the other of the first sealing part 72 and the second sealing part 73 is spaced apart from the inner peripheral surface of the cylindrical wall 46. As a result, when the ink cartridge 30 is mounted in the cartridge-mounting unit 110, the air channels and the liquid channels can be reliably opened with a small mounting force.

Incidentally, it is desirable that the frictional force generated between the second sealing part 73 and the central region 46A of the inner peripheral surface of the cylindrical wall 46 be smaller than the frictional force generated between the first sealing part 72 and the central region 46A of the inner peripheral surface of the cylindrical wall 46. In other words, it is desirable that the contact force between the second sealing part 73 and the central region 46A of the inner peripheral surface of the cylindrical wall 46 be smaller than the contact force between the first sealing part 72 and the central region 46A of the inner peripheral surface of the cylindrical wall 46. A specific method for realizing the above relationship is not specifically limited. For example, the outer diameter of the second sealing part 73 may be made smaller than the outer diameter of the first sealing part 72. Alternatively, the thickness of the second sealing part 73 may be made smaller than the thickness of the first sealing part 72. These configurations may be used in combination.

In the case of an ink cartridge 30 that is unused (that is, an ink cartridge 30 in which the moving member 90 is at the first position), it is desirable that the first sealing part 72 firmly and intimately contacts the inner peripheral surface of the cylindrical wall 46, in order to prevent leakage of ink due to vibration during transportation. However, in the case of an ink cartridge 30 that has been used (that is, an ink cartridge 30 in which the moving member 90 is at the second position), the possibility of leakage of ink is lower than that of the unused one. Accordingly, the contact forces of the first sealing part 72 and the second sealing part 73 with respect to the inner peripheral surface of the cylindrical wall 46 are set as described above to reduce the mounting force particularly during a later stage of the operation for mounting the ink cartridge 30 in the cartridge-mounting unit 110.

Note that, in the above-described embodiment, the first sealing part 72 is completely spaced apart from the proximal-end side region 46B of the inner peripheral surface of the cylindrical wall 46 and the second sealing part 73 is completely spaced apart from the distal-end side region 46C of the inner peripheral surface of the cylindrical wall 46. However, the present invention is not limited to this configuration. For example, the first sealing part 72 and the proximal-end side region 46B may be arranged such that the contact force between the first sealing part 72 and the proximal-end side region 46B of the inner peripheral surface of the cylindrical wall 46 is smaller than the contact force between the first sealing part 72 and the central region 46A of the inner peripheral surface of the cylindrical wall 46. Similarly, the second sealing part 73 and the distal-end side region 46C may be arranged such that the contact force between the second sealing part 73 and the distal-end side region 46C of the inner peripheral surface of the cylindrical wall 46 is smaller than the contact force between the second sealing part 73 and the central region 46A of the inner peripheral surface of the cylindrical wall 46.

Further, in order to realize the above relationship, the inner diameter of the proximal-end side region 46B and the inner diameter of the distal-end side region 46C may be set larger than the inner diameter of the central region 46A. In other words, the cross-sectional area of the internal space surrounded by the proximal-end side region 46B that is taken orthogonal to the depthwise direction 53 and the cross-sectional area of the internal space surrounded by the distal-end side region 46C that is taken orthogonal to the depthwise direction 53 may be larger than the cross-sectional area of the internal space surrounded by the central region 46A that is taken orthogonal to the depthwise direction 53. That is, the first sealing part 72 may intimately contact the proximal-end side region 46B along its entire circumference or part of its circumference, or may be spaced apart from the proximal-end side region 46B along its entire circumference.

The same may also be applied to the relationship between the second sealing part 73 and the distal-end side region 46C. Incidentally, if the first sealing part 72 intimately contacts the proximal-end side region 46B along its entire circumference, the first sealing part 72 needs to be placed at a position closer toward the proximal end of the cylindrical wall 46 from the opening 64 when the moving member 90 is at the second position.

According to the above-described embodiment, in the state where the moving member 90 is at the second position, the first cylindrical wall 75 is fitted with the second cylindrical wall 48 to form a liquid-tight seal with the second cylindrical wall 48, thereby preventing ink that has flowed into the valve chamber 47 through the opening 67 from flowing into the space outside the seal member 70. As a result, even if the contact force of the second sealing part 73 with respect to the inner peripheral surface of the cylindrical wall 46 is reduced, leakage of ink from the opened distal end of the cylindrical wall 46 can be prevented. In this case, in order to further reduce the mounting force for mounting the ink cartridge 30 in the cartridge-mounting unit 110, it is desirable that the sum of the frictional force generated between the second sealing part 73 and the central region 46A of the inner peripheral surface of the cylindrical wall 46 and the frictional force generated between the first cylindrical wall 75 and the second cylindrical wall 48 be smaller than the frictional force generated between the first sealing part 72 and the central region 46A of the inner peripheral surface of the cylindrical wall 46.

Further, according to the above-described embodiment, as the ink cartridge 30 is extracted from the cartridge-mounting unit 110, the moving member 90 is moved by the urging force of the coil spring 83 from the second position shown in FIG. 5C to the first position shown in FIG. 5A. As a result, the valve 80 closes the through-hole 74, and communication is interrupted between the first air channel 60 and the second air channel 63 by the first sealing part 72. Accordingly, leakage of ink in the ink chamber 36 can be prevented after the ink needle 102 is extracted from the valve chamber 47.

As the moving member 90 moves from the second position to the first position, the first cylindrical wall 75 moves away from the second cylindrical wall 48. That is, after the ink needle 102 is extracted from the valve chamber 47, ink that has flowed into the valve chamber 47 through the first liquid channel 66 may flow into the second air channel 63. Further, when the moving member 90 again moves from the first position to the second position, ink inside the second air channel 63 may flow into the first air channel 60. However, the semipermeable membrane 44 is provided to close the opening 62. Hence, ink can be prevented from leaking out of the ink cartridge 30.

Incidentally, the position for attaching the semipermeable membrane 44 is not limited to the position of the opening 62 in the above-described embodiment, but may be any position along the first air channel 60. Further, it is possible to prevent ink from becoming deposited on the semipermeable membrane 44 and blocking flow of air therethrough by providing a labyrinthian structure in an arbitrary position along the first air channel 60 between the opening 61 and the semipermeable membrane 44.

Further, in the above-described embodiment, the inner surface of the cylindrical wall 46, the outer surface of the cylindrical part 71, the outer surfaces of the first and second sealing parts 72 and 73 are circular in a cross-section taken orthogonal to the depthwise direction 53. Accordingly, the contact force between the first and second sealing parts 72 and 73 and the inner peripheral surface of the cylindrical wall 46 is leveled in a circumferential direction of the cylindrical wall 46, resulting in an improvement in the sealing performance of the first and second sealing parts 72 and 73 with respect to the inner peripheral surface of the cylindrical wall 46. The cross-sectional shapes of these members are not limited to the circular shape, but may be an elliptical shape or rectangular shape, for example. Similarly, the cross-sectional shape of the outer surface of the cylindrical wall 46 and other components are not limited to a circular shape.

According to the above-described embodiment, the first liquid channel 66 is provided in the proximal wall 45. With this configuration, the ink chamber 36 can communicate with the valve chamber 47 such that the distance therebetween becomes the shortest. As a result, the simple and compact ink cartridge 30 can be obtained. The position of the first liquid channel 66 is not limited to the above position. For example, the opening 67 may be formed in the inner peripheral surface of the cylindrical wall 46 at a position toward the proximal end of the cylindrical wall 46 from the openings 61 and 64. That is, the opening 67 can be formed in the front surface of the proximal wall 45 or in the inner peripheral surface of the cylindrical wall 46 at a position closer to the proximal end of the cylindrical wall 46 than the openings 61 and 64 are to the proximal end of the cylindrical wall 46.

According to the above-described embodiment, the seal member 70 is fitted with the reinforcement member 76 having high rigidity, thereby ensuring that the first sealing part 72 and the second sealing part 73 intimately contact the inner peripheral surface of the cylindrical wall 46. That is, the sealing performance of the first sealing part 72 and the second sealing part 73 is improved. Accordingly, it is preferred that at least one of the first sealing part 72 and the second sealing part 73 be provided at the large diameter part 70B of the seal member 70 that is reinforced by the reinforcement member 76. Note that the first sealing part 72 and the second sealing part 73 may be configured of O-rings or the like that fit into circumferential grooves formed in the cylindrical part 71, for example.

Further, according to the above-described embodiment, the openings 61 and 64 are formed in the same position along the circumferential direction of the cylindrical wall 46 while being spaced apart from each other in the depthwise direction 53. However, the positional relationship between these openings 61 and 64 is not limited to the example in the above-described embodiment. For example, the openings 61 and 64 may be provided at the same position in the depthwise direction 53 while being spaced apart from each other along the circumferential direction of the cylindrical wall 46 or may be provided at positions spaced apart from each other in both the depthwise direction 53 and the circumferential direction of the cylindrical wall 46. In such cases, the first sealing part 72 may be formed in any shape as long as communication can be interrupted between the openings 61 and 64 when the moving member 90 is at the first position (i.e. provided that the first sealing part 72 is formed in an annular shape and makes a loop around the entire outer circumferential surface of the cylindrical part 71).

For example, the first sealing part 72 may circumscribe the outer circumferential surface of the cylindrical part 71 along a plane that intersects the depthwise direction 53 (a plane orthogonal to the depthwise direction 53 in the above-described embodiment). In other words, any tangent to the cylindrical part 71 that falls in this plane intersects the depthwise direction 53. The first sealing part 72 also need not be provided within a single plane, but may curve or meander around the cylindrical part 71. In such a case, a portion of the first sealing part 72 may extend along the depthwise direction 53. The same structural modifications may also be applied to the second sealing part 73.

The position of the valve chamber 47 is also not limited to the example in the above-described embodiment. For example, the cylindrical wall 46 may protrude outward from the front surface of the front wall 40, in which case the front wall 40 also serves as the proximal wall 45. Further, the interior of a through-hole penetrating the front wall 40 in its thickness dimension (i.e. in the depthwise direction 53 or the mounting and removing directions 50) may serve as the valve chamber 47, in which case the cylindrical wall 46 is omitted and the inner surface of the through-hole serves as the side wall surface.

<First Modification>

With reference to FIGS. 6A through 6D, a configuration inside the valve chamber 47 according to a first modification of the above-described embodiment will be described, wherein like parts and components are designated with the same reference numerals to avoid duplicating description. In the following description, only parts differing from those of the above-described embodiment will be described in detail.

The first modification is different from the above-described embodiment in that a seal member 170 includes a first cylindrical wall 175 in place of the first cylindrical wall 75, and the second cylindrical wall 48 is not provided on a proximal wall 145. In the first modification, the first cylindrical wall 175 is configured to contact the proximal wall 145 to elastically deform. The seal member 170, the reinforcement member 76 and the valve 80 constitute a moving member 190 according to the first modification.

Figure 6C:
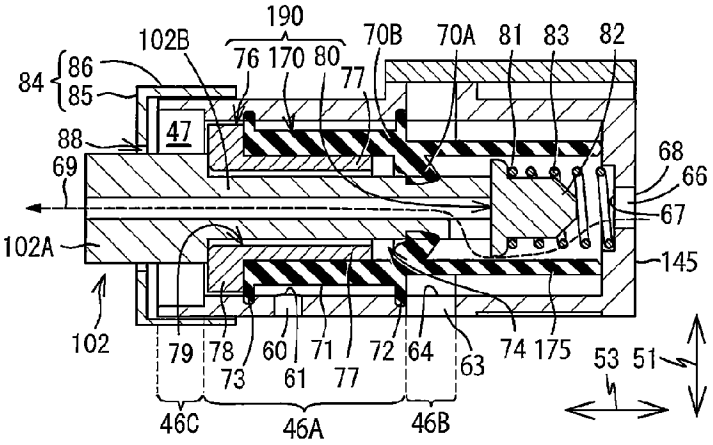
Figure 6D:
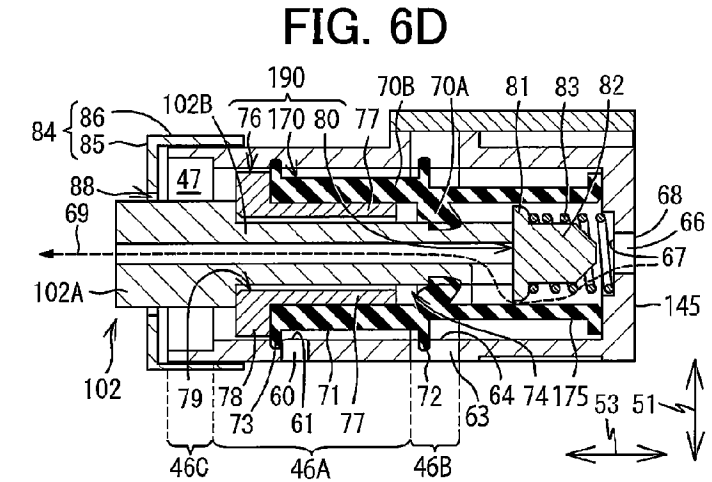
Figure 6A:
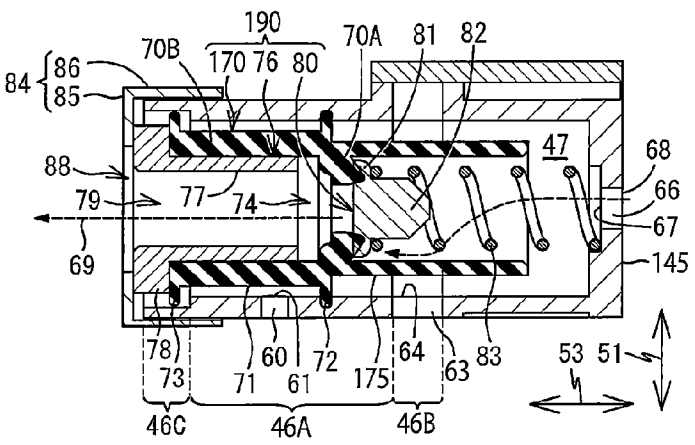
Figure 6B:
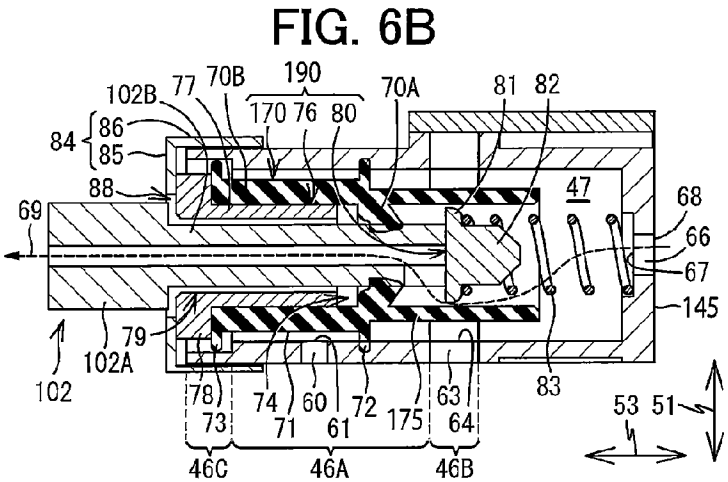

The configuration inside the valve chamber 47 shown in FIGS. 6A and 6B is similar to that shown in FIGS. 5A and 5B. The position of the moving member 190 shown in FIG. 6C is an example of a third position between the first and second positions. When the moving member 190 is at the third position, both the first sealing part 72 and the second sealing part 73 of the seal member 170 intimately contact the central region 46A of the inner peripheral surface of the cylindrical wall 46. Further, at this time, the first cylindrical wall 175 of the seal member 170 contacts the proximal wall 145 at a position where a distal end (an end facing the proximal wall 145, i.e. rear end) of the first cylindrical wall 175 surrounds the opening 67.

Then, as the moving member 190 moves from the third position shown in FIG. 6C to the second position shown in FIG. 6D, the first cylindrical wall 175 elastically deforms such that the length of the first cylindrical wall 175 in the depthwise direction 53 is reduced. More specifically, the distal end of the first cylindrical wall 175 elastically deforms outward in a direction that expands its outer diameter. Note that the positions of the first sealing part 72, the second sealing part 73, and the valve 80 shown in FIG. 6D are similar to those shown in FIG. 5C, and therefore will not be described again. The first cylindrical wall 75 and 175 in the present invention can be of any configuration as long as the first cylindrical wall 75 and 175 can surround the opening 67 to form a liquid-tight seal in the opening 67 when the moving member 90, 190 is at the second position.

<Second Modification>

Figure 7A:
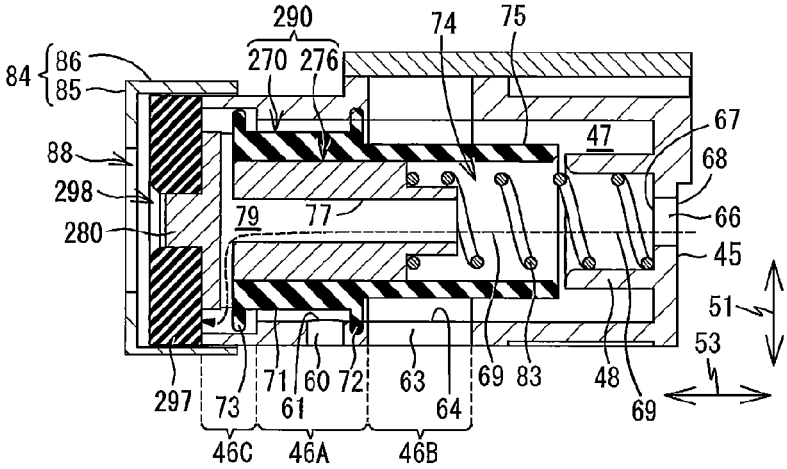
Figure 7B:
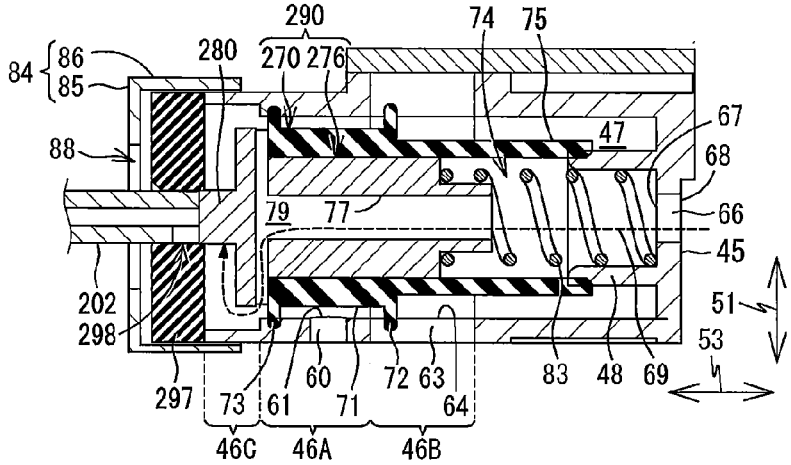
Figure 7C:
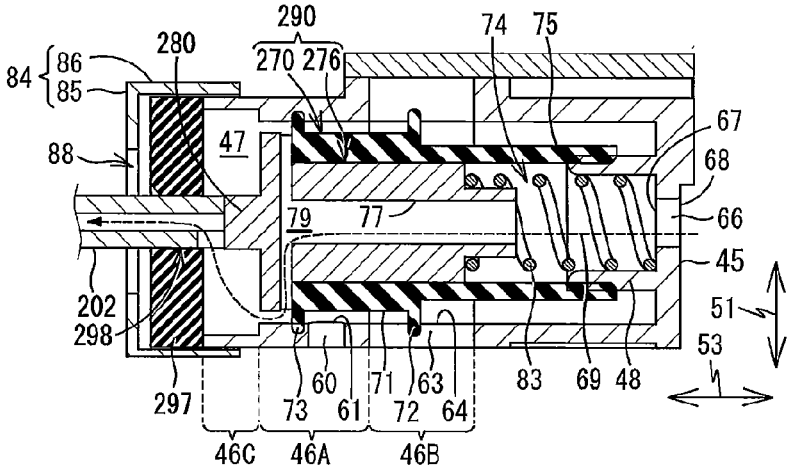

With reference to FIG. 7A through 7C, a configuration inside the valve chamber 47 according to a second modification will be described, wherein like parts and components are designated with the same reference numerals to avoid duplicating description. In the following description, only parts differing from those of the above-described embodiment will be described in detail.

The second modification is different from the above-described embodiment in that a valve 280 is provided at a reinforcement member 276 and moves inside the valve chamber 47 together with the first sealing part 72 and the second sealing part 73 provided in a seal member 270. Further, a sealing member 297 is attached to the distal end of the cylindrical wall 46. Still further, an ink needle 202 has a uniform outer diameter in its longitudinal dimension. The seal member 270 and the reinforcement member 276 provided with the valve 280 constitute a moving member 290 according to the second modification.

As shown in FIGS. 7A through 7C, the sealing member 297 has a disc shape and has an outer diameter substantially equivalent to the outer diameter of the cylindrical wall 46. The sealing member 297 contacts the distal end of the cylindrical wall 46 to form a liquid-tight seal with the distal end of the cylindrical wall 46. A through-hole 298 is formed in the sealing member 297 and penetrates the center region of the sealing member 297 in its thickness dimension (in the depthwise direction 53 or the mounting and removing directions 50). The through-hole 298 provides communication between the interior and exterior of the valve chamber 47. The diameter of the through-hole 298 is slightly smaller than the outer diameter of the ink needle 202 and the outer diameter of the valve 280. The sealing member 297 is formed of rubber or another elastic material. The cap 84 holds the sealing member 297 at the distal end of the cylindrical wall 46.

The valve 280 is provided on a surface of the reinforcement member 276 facing the distal end of the cylindrical wall 46, and protrudes toward the distal end of the cylindrical wall 46. The valve 280 is columnar in shape. The outer diameter of the reinforcement member 276 on the proximal side of the cylindrical wall 46 is smaller than the inner diameter of the seal member 270. Hence, a gap is formed between the seal member 270 and the reinforcement member 276 continuously in their circumferential direction, while extending in their radial direction. The coil spring 83 enters this gap to urge the moving member 290 toward the distal end of the cylindrical wall 46. Further, the through-hole 79 formed in the reinforcement member 276 has one end that is open at an endface of the reinforcement member 276 facing the proximal end of the cylindrical wall 46, and the other end that is open at an outer peripheral surface of the reinforcement member 276 at a position toward the distal end of the cylindrical wall 46 from the second sealing part 73. A channel extending from the opening 67 to the through-hole 298 through the through-holes 74 and 79 is an example of the second liquid channel 69 according to the second modification.

As shown in FIG. 7A, in a state where the moving member 290 is at the first position, the valve 280 is inserted into the through-hole 298 and pressed against the through-hole 298. More specifically, the valve 280 contacts the inner circumferential surface of the sealing member 297 defining the through-hole 298, causing the inner circumferential surface to elastically deform in a direction radially outward. That is, the second liquid channel 69 is sealed off at the through-hole 298. Note that the positions of the first sealing part 72, the second sealing part 73, and the first cylindrical wall 75 shown in FIG. 7A are similar to those shown in FIG. 5A, and therefore will not be described again.

Then, as shown in FIG. 7B, the ink needle 202 is inserted into the valve chamber 47 through the through-holes 88 and 298, pressing a distal end (front end) of the valve 280. Consequently, the moving member 290 moves against the urging force of the coil spring 83 toward the proximal end of the cylindrical wall 46. The position of the moving member 290 shown in FIG. 7B is an example of a third position according to the second modification.

In a state where the moving member 290 is at the third position, the first sealing part 72 is positioned in the internal space surrounded by the proximal-end side region 46B. Accordingly, the first air channel 60 communicates with the second air channel 63. As a result, the ink chamber 36 communicates with external air through the first air channel 60, the valve chamber 47, and the second air channel 63. At this time, the second sealing part 73 is positioned in the internal space surrounded by the central region 46A, and contacts and forms an airtight seal with the central region 46A at a position toward the distal end of the cylindrical wall 46 from the opening 61. Accordingly, the second sealing part 73 interrupts communication between the first and second air channels 60 and 63 and the through-hole 298. Further, the first cylindrical wall 75 is fitted with the second cylindrical wall 48. Accordingly, communication is interrupted between the first and second air channels 60 and 63 and the first and second liquid channels 66 and 69. Meanwhile, the valve 280 still remains inserted in and pressed against the through-hole 298. That is, the second liquid channel 69 is still sealed off at the through-hole 298.

Then, as shown in FIG. 7C, the ink needle 202 is inserted farther into the valve chamber 47, and moves the moving member 290 against the urging force of the coil spring 83 toward the proximal end of the cylindrical wall 46. The position of the moving member 290 shown in FIG. 7C is an example of a second position according to the second modification. When the moving member 290 is at the second position, the valve 280 is separated from the through-hole 298. Accordingly, ink in the ink chamber 36 can flow out of the ink cartridge 30 through the first liquid channel 66, the second liquid channel 69, and the ink needle 202. Note that the positions of the first sealing part 72, the second sealing part 73, and the first cylindrical wall 75 shown in FIG. 7C are similar to those shown in FIG. 5C, and therefore will not be described again.

According to the second modification, before the first liquid channel 66 and the second liquid channel 69 communicate with the ink needle 202, the first air channel 60 communicates with the second air channel 63. With this arrangement, the ink chamber 36 communicates with external air before ink in the ink chamber 36 flows out of the ink cartridge 30 through the ink needle 202. As a result, abrupt movement of ink caused by a difference in pressure between the interior and exterior of the ink cartridge 30 can be suppressed. Hence, this configuration prevents the meniscus of ink in the nozzles 29 from being destroyed.

Incidentally, in the above-described embodiment and the first and second modifications, ink is described as an example of liquid. However, the present invention is not limited to this. In place of the ink, a pretreatment liquid that is ejected onto recording paper prior to ink ejection during image formation may serve as the liquid. Alternatively, water that is sprayed near the nozzles 29 provided in the recording head 21 for preventing drying of the nozzles 29 may also serve as the liquid.

Incidentally, in the above-described embodiment and the first and second modifications, the mounting and removing directions 50 of the ink cartridge 30 with respect to the cartridge-mounting unit 110 are horizontal directions. However, the present invention is not limited to this. The mounting and removing directions 50 may be directions that intersect the horizontal directions.

In the second modification described above, the diameter of the through-hole 298 formed in the sealing member 297 is slightly smaller than the outer diameter of the ink needle 202 and the outer diameter of the valve 280. However, the present invention is not limited to this arrangement. That is, at least part of the through-hole 298 formed in the sealing member 297 may be closed by the elasticity of the sealing member 297 itself when the ink needle 202 is not inserted into the through-hole 298. With this configuration, the coil spring 83 need not be provided in the valve chamber 47. If the coil spring 83 is omitted from the valve chamber 47, then once the ink needle 202 moves the moving member 290 into the second position, the moving member 290 will remain in the second position after the ink needle 202 is extracted from the valve chamber 47. Therefore, while the valve 280 will not be in contact with the sealing member 297, but the elasticity of the sealing member 297 will at least partially close the through-hole 298, suppressing the outflow of ink from the valve chamber 47 through the through-hole 298.

While the present invention has been described in detail with reference to the embodiment thereof, it would be apparent to those skilled in the art that various changes and modifications may be made therein without departing from the spirit of the present invention.

What is claimed is:

1. A liquid cartridge comprising:

a liquid chamber configured to store liquid therein;

a valve chamber defined by a side wall surface and a base wall surface, the side wall surface extending in a first direction away from the liquid chamber and having an annular shape in cross-section taken along a plane orthogonal to the first direction, the side wall surface having a first end at which the base wall surface is provided and a second end which is an open end and positioned downstream of the first end in the first direction, the side wall surface having a first opening and a second opening, one of the side wall surface and the base wall surface having a third opening at a position upstream of the first opening and the second opening in the first direction;

a moving member disposed in the valve chamber and configured to move in a second direction opposite to the first direction, the moving member having an outer surface and a through-hole, the through-hole being configured to allow communication between a space in the valve chamber near the first end of the side wall surface and a space in the valve chamber near the second end of the side wall surface;

a first sealing part having an annular shape and provided on the outer surface of the moving member;

a second sealing part having an annular shape and provided on the outer surface of the moving member at a position downstream of the first sealing part in the first direction;

a first air channel configured to provide communication between the valve chamber and an atmosphere through the first opening;

a second air channel configured to allow air to flow between the valve chamber and the liquid chamber through the second opening;

a first liquid channel configured to allow liquid to flow between the valve chamber and the liquid chamber through the third opening; and a second liquid channel extending from the third opening to the second end of the side wall surface through the through-hole formed in the moving member, wherein the side wall surface includes:

a central region in which the first opening is formed, the first sealing part and the second sealing part being configured to intimately contact the central region along its entire circumference to provide airtight seal, the central region defining a first internal space having a first cross-sectional area taken along a plane orthogonal to the first direction;

a first-end side region in which the second opening is formed, the first-end side region being positioned upstream of the central region in the first direction, the first-end side region defining a second internal space having a second cross-sectional area taken along a plane orthogonal to the first direction; and a second-end side region positioned downstream of the central region in the first direction, the second-end side region defining a third internal space having a third cross-sectional area taken along a plane orthogonal to the first direction, the second cross-sectional area being greater than the first cross-sectional area, and the third cross-sectional area being greater than the first cross-sectional area, and wherein the moving member includes a valve configured to close and open the second liquid channel, the moving member being configured to move from a first position to a second position closer to the first end of the side wall surface than the first position to the first end of the side wall surface, wherein in the first position, the first sealing part is positioned within the first internal space surrounded by the central region at a position upstream of the first opening in the first direction, the second sealing part being positioned within the third internal space surrounded by the second-end side region, and the valve closing the second liquid channel; and in the second position, the first sealing part is positioned within the second internal space surrounded by the first-end side region to provide communication between the first opening and the second opening, the second sealing part being positioned within the first internal space surrounded by the central region at a position downstream of the first opening in the first direction, and the valve opening the second liquid channel.

2. The liquid cartridge as claimed in claim 1, wherein the first sealing part and the central region generates a first frictional force therebetween, the second sealing part and the central region generating a second frictional force therebetween, the second frictional force being smaller than the first frictional force.

3. The liquid cartridge as claimed in claim 1, wherein the third opening is formed in the base wall surface, wherein the moving member has a fourth opening in communication with the through-hole formed in the moving member, the fourth opening facing the base wall surface, and wherein the moving member includes a first cylindrical wall protruding in the second direction at a position surrounding the fourth opening, the first cylindrical wall being configured to surround the third opening to provide a liquid-tight seal when the moving member is at the second position.

4. The liquid cartridge as claimed in claim 3, further comprising a second cylindrical wall provided at the base wall surface and protruding in the first direction at a position surrounding the third opening, and wherein when the moving member is at the second position, the first cylindrical wall is fitted with the second cylindrical wall to form a liquid-tight seal with the second cylindrical wall.

5. The liquid cartridge as claimed in claim 4, wherein the first sealing part and the central region generates a first frictional force therebetween, the second sealing part and the central region generating a second frictional force therebetween, the first cylindrical wall and the second cylindrical wall generating a third frictional force therebetween, a sum of the second frictional force and the third frictional force being smaller than the first frictional force.

6. The liquid cartridge as claimed in claim 3, wherein the first cylindrical wall has an end facing the base wall surface, and a length in the second direction, and wherein when the moving member is being moved from the first position to the second position, the end of the first cylindrical wall is brought into contact with the base wall surface at a position surrounding the third opening and elastically deforms so as to reduce the length in the second direction.

7. The liquid cartridge as claimed in claim 1, wherein the moving member comprises a seal member and the valve provided separately from the seal member, the first sealing part and the second sealing part being provided at the seal member, the through-hole being formed in the seal member, wherein the seal member has a fourth opening in communication with the through-hole, the fourth opening facing the base wall surface and being defined by a peripheral surface, and wherein the valve is configured to move between a closed position in which the valve intimately contacts the peripheral surface of the fourth opening to close the through-hole, and an open position in which the valve is separated from the peripheral surface of the fourth opening to open the through-hole.

8. The liquid cartridge as claimed in claim 1, wherein further comprising a sealing member provided at the second end of the side wall surface and having a through-hole for providing communication between interior and exterior of the valve chamber, wherein the valve is provided in the moving member near the second end of the side wall surface and protrudes in the first direction, wherein the moving member is configured to move from the first position to a third position, and then, from the third position to the second position, wherein, in the third position, the first sealing part is positioned in the second internal space surrounded by the first-end side region to provide communication between the first opening and the second opening, the second sealing part being positioned in the first internal space surrounded by the central region at a position downstream of the first opening in the first direction, wherein when the moving member is at the first position and the third position, the valve is inserted into and pressed against the through-hole formed in the sealing member, and wherein when the moving member is at the second position, the valve is separated from the through-hole formed in the sealing member.

9. The liquid cartridge as claimed in claim 1, wherein the first sealing part has a first circumferential surface, and the second sealing part has a second circumferential surface, wherein when the moving member is at the second position, the first circumferential surface of first sealing part is spaced apart from the first-end side region, and wherein when the moving member is at the first position, the second circumferential surface of the second sealing part is spaced apart from the second-end side region.

10. The liquid cartridge as claimed in claim 1, further comprising an urging member disposed in the valve chamber at a position between the base wall surface and the moving member, the urging member being configured to urge the moving member in the first direction, and wherein the moving member is disposed in the valve chamber so as to be movable in the first direction and in the second direction.

11. The liquid cartridge as claimed in claim 1, wherein the side wall surface and the outer surface of the moving member have a circular shape in a cross-section taken along a plane orthogonal to the first direction, wherein the first sealing part and the second sealing part have a flange shape that protrudes radially outward from the outer surface of the moving member.

12. A liquid cartridge comprising:

a liquid chamber configured to store liquid therein;

a valve chamber defined by a side wall surface and a base wall surface, the side wall surface extending in a first direction away from the liquid chamber and having an annular shape in cross-section taken along a plane orthogonal to the first direction, the side wall surface having a first end at which the base wall surface is provided and a second end which is an open end and positioned downstream of the first end in the first direction, the side wall surface having a first opening and a second opening, one of the side wall surface and the base wall surface having a third opening at a position upstream of the first opening and the second opening in the first direction, the side wall surface including:

a central region in which the first opening is formed, the central region defining a first internal space having a first cross-sectional area taken along a plane orthogonal to the first direction;

a first-end side region in which the second opening is formed, the first-end side region being positioned upstream of the central region in the first direction, the first-end side region defining a second internal space having a second cross-sectional area taken along a plane orthogonal to the first direction; and a second-end side region positioned downstream of the central region in the first direction, the second-end side region defining a third internal space having a third cross-sectional area taken along a plane orthogonal to the first direction, the second cross-sectional area being greater than the first cross-sectional area, and the third cross-sectional area being greater than the first cross-sectional area;

a moving member movably disposed in the valve chamber and configured to move in a second direction opposite to the first direction, the moving member comprising:

a cylindrical part having an outer surface and a through-hole;

a first sealing part having an annular shape and protruding outward from the outer surface;

a second sealing part having an annular shape and protruding outward from the outer surface at a position downstream of the first sealing part in the first direction, the first sealing part and the second sealing part being configured to intimately contact the central region along its entire circumference to provide air-tight seal; and a valve seat provided in the through hole;

a first air channel configured to provide communication between the valve chamber and an atmosphere through the first opening;

a second air channel configured to allow air to flow between the valve chamber and the liquid chamber through the second opening;

a first liquid channel configured to allow liquid to flow between the valve chamber and the liquid chamber through the third opening; and a second liquid channel extending from the third opening to the second end of the side wall surface through the through-hole;

a valve configured to be seated on and separated from the valve seat to close and open the second liquid channel;

wherein the moving member is configured to move from a first position to a second position closer to the first end of the side wall surface than the first position to the first end of the side wall surface, wherein in the first position, the first sealing part is positioned within the first internal space surrounded by the central region at a position upstream of the first opening in the first direction, the second sealing part being positioned within the third internal space surrounded by the second-end side region, and the valve closing the second liquid channel; and in the second position, the first sealing part is positioned within the second internal space surrounded by the first-end side region to provide communication between the first opening and the second opening, the second sealing part being positioned within the first internal space surrounded by the central region at a position downstream of the first opening in the first direction, and the valve opening the second liquid channel.

* * * * *